US011994125B2

(12) United States Patent
Myers et al.

(10) Patent No.: US 11,994,125 B2
(45) Date of Patent: May 28, 2024

(54) VALVE STOP AND SUCTION COVER PLATFORMED ASSEMBLY

(71) Applicant: SPM Oil & Gas Inc., Fort Worth, TX (US)

(72) Inventors: Jeff Myers, Fort Worth, TX (US); John Steven Marquez, Jr., Saginaw, TX (US); Adalberto Cortes, Fort Worth, TX (US); Johnny E. DeLeon, II, Fort Worth, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 138 days.

(21) Appl. No.: 17/442,097

(22) PCT Filed: Jul. 21, 2020

(86) PCT No.: PCT/US2020/042863
§ 371 (c)(1),
(2) Date: Sep. 22, 2021

(87) PCT Pub. No.: WO2021/016232
PCT Pub. Date: Jan. 28, 2021

(65) Prior Publication Data

US 2022/0163033 A1 May 26, 2022

Related U.S. Application Data

(60) Provisional application No. 62/877,109, filed on Jul. 22, 2019.

(51) Int. Cl.
*F04B 53/00* (2006.01)
*F04B 39/12* (2006.01)
(Continued)

(52) U.S. Cl.
CPC ..... *F04B 53/007* (2013.01); *F04B 39/122* (2013.01); *F04B 39/125* (2013.01); *F04B 53/1032* (2013.01); *F04B 53/16* (2013.01)

(58) Field of Classification Search
CPC .... F04B 53/007; F04B 53/1032; F04B 53/16; F04B 39/122; F04B 39/125; F04B 39/14; F04B 53/162; F04B 53/22
See application file for complete search history.

(56) References Cited

U.S. PATENT DOCUMENTS 7,364,412 B2 * 4/2008 Kugelev ..... F04B 53/007 417/454
8,662,864 B2 * 3/2014 Bayyouk ..... F04B 1/00 417/415

(Continued)

FOREIGN PATENT DOCUMENTS

WO WO-2017/209725 12/2017
WO WO-2019/016621 1/2019

OTHER PUBLICATIONS

International Search Report and Written Opinion for International Patent Application No. PCT/US2020/042863 dated Nov. 20, 2020.

*Primary Examiner* — Bryan M Lettman
(74) *Attorney, Agent, or Firm* — Foley & Lardner LLP

(57) ABSTRACT

A fluid end of a reciprocating pump assembly includes a cylinder, a cover, and a valve stop. The cylinder has a fluid inlet, a fluid outlet, and an access side wall comprising an access wall inner surface that defines an access opening. The access opening provides access to an inner area of the cylinder and has an access opening axis. The cover is positioned in the access opening and forms a seal with the access wall inner surface along the access opening. The cover includes a cover axis coaxial with the access opening axis. The valve stop is positioned partially in the fluid inlet and includes a spring retainer and a column portion. The
(Continued)

column portion includes a flange positioned between the cover and the access wall inner surface. The flange is in the shape of an arc.

17 Claims, 9 Drawing Sheets

(51) Int. Cl.
*F04B 53/10* (2006.01)
*F04B 53/16* (2006.01)

(56) References Cited

U.S. PATENT DOCUMENTS

| | | | | |
|---|---|---|---|---|
| 9,822,894 | B2 * | 11/2017 | Bayyouk | F04B 53/1087 |
| 2013/0202457 | A1 * | 8/2013 | Bayyouk | F16K 15/063 417/279 |
| 2013/0202458 | A1 * | 8/2013 | Byrne | F04B 7/02 417/279 |
| 2014/0137963 | A1 * | 5/2014 | Blume | F04B 9/1095 137/565.23 |
| 2017/0146011 | A1 * | 5/2017 | Hiller | F04B 53/14 |
| 2017/0152851 | A1 * | 6/2017 | Chhabra | F16K 27/02 |
| 2017/0204850 | A1 * | 7/2017 | Graham | F04B 49/24 |
| 2017/0298932 | A1 * | 10/2017 | Wagner | F04B 53/1087 |

* cited by examiner

VALVE STOP AND SUCTION COVER PLATFORMED ASSEMBLY

CROSS-REFERENCE TO RELATED PATENT APPLICATIONS

This application is filed under 35 U.S.C. 371, and claims the benefit of and priority to PCT/US2020/042863, having a filing date of Jul. 21, 2020, entitled "VALVE STOP AND SUCTION COVER PLATFORMED ASSEMBLY," which claims the benefit of and priority to U.S. Provisional Patent Application No. 62/877,109, having a filing date of Jul. 22, 2019, entitled "VALVE STOP AND SUCTION PLATFORMED ASSEMBLY, both of which are incorporated herein by reference in their entirety for all purposes.

TECHNICAL FIELD

This disclosure relates to valve stop assemblies for reciprocating pumps.

BACKGROUND

In oil field services, reciprocating pumps are used for various purposes. Some reciprocating pumps are used for operations such as cementing, acidizing, or fracing a well. An example of one reciprocating pump is disclosed in U.S. Pat. No. 7,364,412, the entire disclosure of which is incorporated herein by reference. These types of service pumps may operate frequently for relatively short periods of time. Reciprocating pumps typically include a plunger for pumping fluid through a cylinder, which includes a fluid inlet and a fluid outlet. An opening in the pump provides access to the cylinder for installation and servicing purposes. The opening may be sealed with a cover and a nut that form a portion of a suction or discharge cover assembly. A valve spring retainer is also included as part of the cover assembly. The valve spring retainer seats within a fluid port of the pump and retains a spring therein. Installation of the suction or discharge cover assemblies may be challenging due generally to the tight clearances of the assemblies. In addition, installation may be difficult due to the nature of the design of the valve spring retainer. These difficulties in installation may lead to the product being used incorrectly and potentially breaking as a result.

SUMMARY

One embodiment relates to a fluid end of a reciprocating pump assembly. The fluid end includes a cylinder, a cover, and a valve stop. The cylinder has a fluid inlet, a fluid outlet, and an access side wall comprising an access wall inner surface that defines an access opening. The access opening provides access to an inner area of the cylinder and has an access opening axis. The cover is positioned in the access opening and forms a seal with the access wall inner surface along the access opening. The cover includes a cover axis coaxial with the access opening axis. The valve stop is positioned partially in the fluid inlet and includes a spring retainer and a column portion. The column portion includes a flange positioned between the cover and the access wall inner surface. The flange comprises an arc shape.

Another embodiment relates to a valve stop assembly. The valve stop assembly includes a cover and a valve stop. The cover comprises a cover axis. The valve stop includes a spring retainer and a column portion including a flange that includes an arc shape.

Another embodiment relates to a fluid end of a reciprocating pump assembly. The fluid end includes a cylinder and a discharge cover. The cylinder has a fluid inlet, a fluid outlet, and an access side wall comprising an access wall inner surface that defines an access opening. The access opening provides access to an inner area of the cylinder and has an access opening axis. The discharge cover is positioned in the access opening and forms a seal with the access wall inner surface along the access opening. The discharge cover comprises a cover axis coaxial with the access opening axis.

These and other features, together with the organization and manner of operation thereof, will become apparent from the following detailed description when taken in conjunction with the accompanying drawings, wherein like elements have like numerals throughout the several drawings described below.

DETAILED DESCRIPTION

Figure 14:
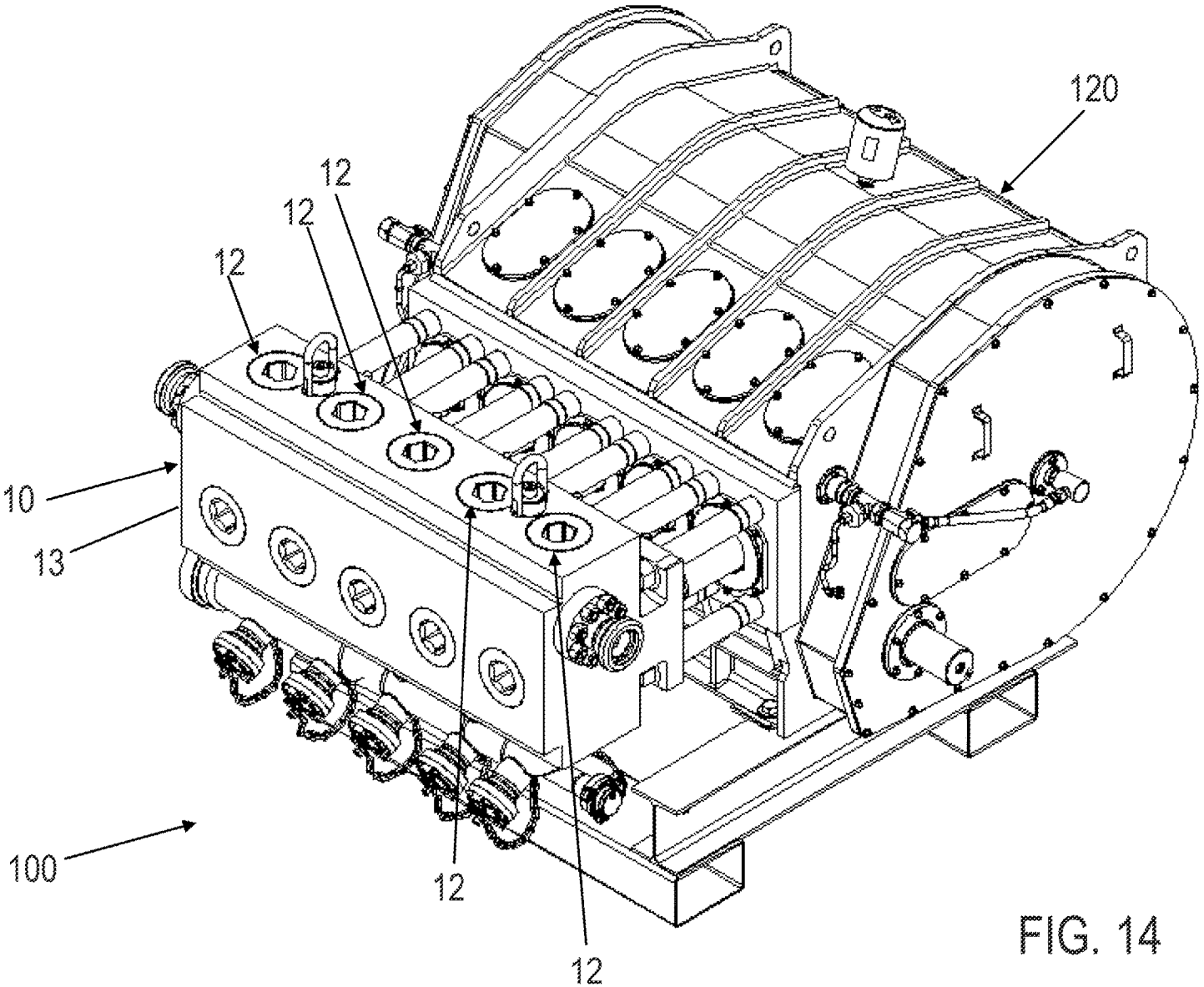
FIG. 14 shows a perspective view of a reciprocating pump assembly with a fluid end according to one embodiment.

A reciprocating pump assembly 100, as shown in FIG. 14, may be configured to pump high pressure fracturing ("frac") fluids into wells for recovery of oil and gas trapped in, for example, shale formations. The reciprocating pump assembly 100 comprises a power end 120 and a fluid end 10 that are coupled to each other. The power end 120 may be driven by and coupled to, for example only, a diesel engine and transmission in order to drive any pumps or plungers in the fluid end 10.

Referring to FIGS. 1-4, the fluid end 10 of the reciprocating pump assembly 100 is shown, according to an exemplary embodiment. The configuration of the fluid end 10 allows for ease of installation, assembly, and removal, while maintaining correct alignment within the fluid end 10. The fluid end 10 (which may be referred to as a pump body or a fluid end assembly) is supplied with a fluid (such a water and/or other fluids) via a fluid inlet 14 of the fluid end 10. The fluid is pressurized within the fluid end 10 and discharged out from the fluid end 10 via a fluid outlet 16 of the fluid end 10 (which may be a high pressure outlet).

The fluid end 10 comprises a fluid end housing, monoblock fluid ends, or block 13 that is substantially rectangular in shape. The block 13 includes a top wall 13*a*, a bottom wall 13*b*, a plunger housing side wall 13*c*, an access side wall 13*d*, a first end wall 13*e*, and a second end wall 13*f* (which may each be separate walls). The top wall 13*a* and the bottom wall 13*b* are opposite each other, the plunger housing side wall 13*c* and the access side wall 13*d* are opposite each other, and the first end wall 13*e* and the second end wall 13*f* are opposite each other.

The block 13 of the fluid end 10 includes or defines at least one (and preferably a plurality or set of) fluid cylinder 12 (which may be referred to as a cylinder assembly). The block 13 may be bored as a single part with a plurality of cylinders or may be an assembly of individual bodies with cylinders (e.g., modular fluid ends). The various cylinders 12 may be positioned next to each other along the length of the block 13 and between the first end wall 13*e* and the second end wall 13*f*.

The fluid end 10 comprises a cylinder 12 to correspond with and receive each of the pumps (and corresponding plungers or pistons), where each of the pumps are configured to pump fluid through the respective cylinder 12. Any number of pumps may be included within the pump assembly 100 and any corresponding number of cylinders 12 may be formed or bored within the block 13, depending on the desired configuration (as shown, for example, in FIGS. 1 and 14). For example, the reciprocating pump assembly 100 may be a multiplex reciprocating pump assembly with a plurality of pumps, pump throws, and cylinders 12. For example, according to various embodiments, the reciprocating pump assembly 100 may be a triplex pump assembly with three pumps, three plunger throws, and three corresponding cylinders 12 or a quintuplex pump assembly with five pumps, five plunger throws, and five corresponding cylinders 12. Each of the plunger throws houses a plunger rod connected to the plunger for pumping fluid passing through each cylinder 12. The reciprocating pump assembly 100 disclosed herein may include any number of pumps and cylinders 12 according to the desired configuration.

Each cylinder 12 includes a cylinder center chamber, interior, or inner area 15 configured to receive fluid being pumped by the rest of the reciprocating pump assembly 100 and provide an area where the respective plunger of the cylinder 12 compresses or pressurizes the fluid as the plunger translates within the plunger bore 18. Each cylinder 12 includes an inlet valve (positioned within the fluid inlet 14) and an outlet valve (positioned within the fluid outlet 16) (not shown). The valves are typically spring-loaded valves and are actuated by differential pressure. The inlet valve controls fluid flow through the fluid inlet 14, and the outlet valve controls fluid flow through the fluid outlet 16. The cylinder 12 may comprise a valve spring 28 (as shown in FIGS. 4-5) positioned within the fluid inlet 14 and/or the fluid outlet 16 that is configured to be used with a valve positioned within the fluid inlet 14 and/or the fluid outlet 16.

Figure 4:
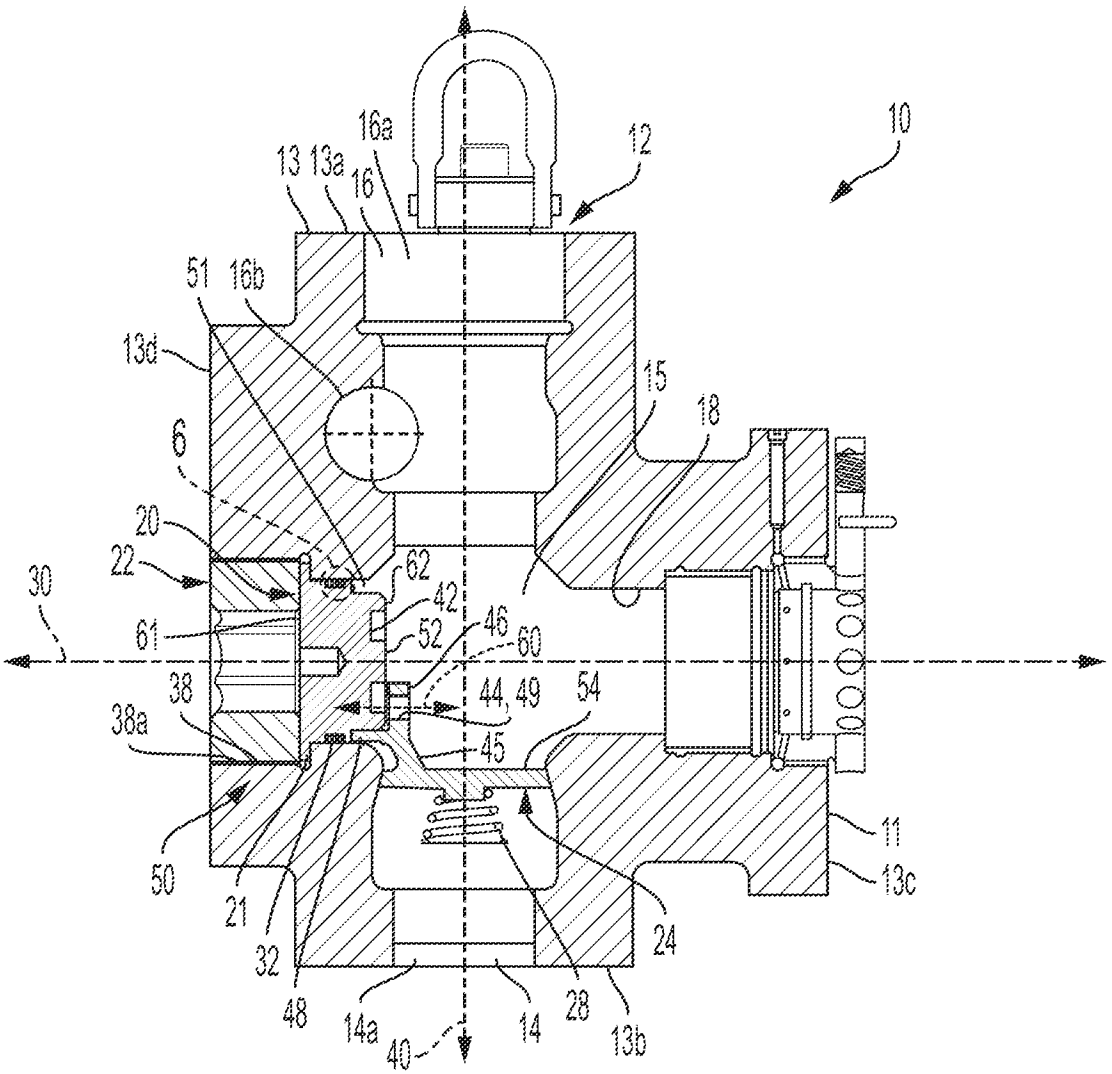
FIG. 4 shows a section view of the fluid end of the reciprocating pump assembly of FIG. 1 taken along section line 4-4 in FIG. 2.
Figure 5:
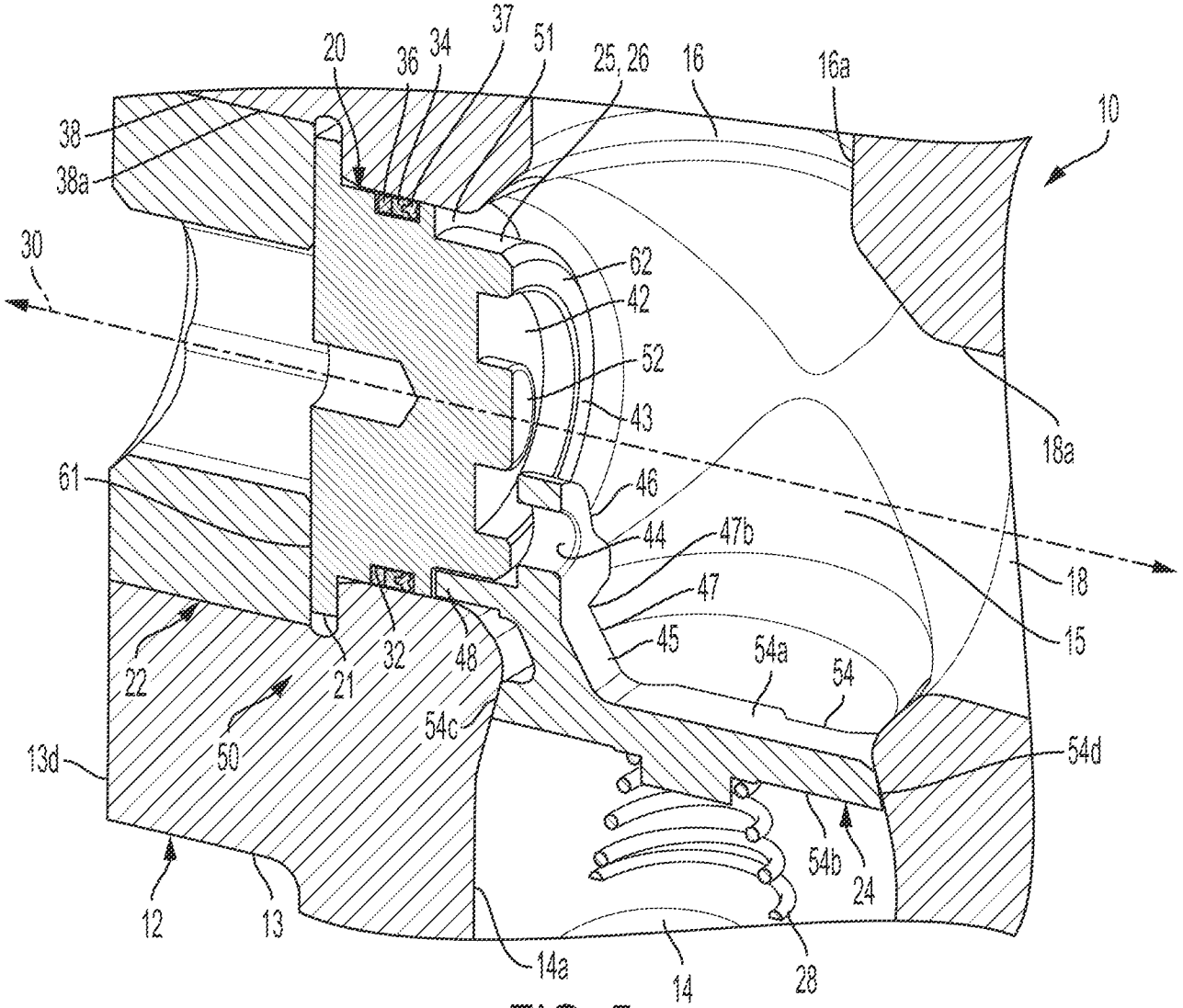
FIG. 5 shows a perspective section view of the fluid end of the reciprocating pump assembly of FIG. 1.

As shown in FIG. 4, each cylinder 12 includes a suction fluid inlet 14, a high pressure discharge fluid outlet 16, a plunger bore 18, and an access opening 38, each of which may be bores, ports, through-holes, or openings and are defined by different walls of the block 13. In particular, the fluid inlet 14 is defined by and extends completely through the bottom wall 13*b* (between the outer surface of the bottom wall 13*b* and the inner area 15), the fluid outlet 16 is defined by and extends completely through the top wall 13*a* (between the outer surface of the top wall 13*a* and the inner area 15), the plunger bore 18 is defined by and extends completely through the plunger housing side wall 13*c* (between the outer surface of the plunger housing side wall 13*c* and the inner area 15), and the access opening 38 is defined by and extends completely through the access side wall 13*d* (between the outer surface of the access side wall 13*d* and the inner area 15). Each of the fluid inlet 14, the fluid outlet 16, the plunger bore 18, and the access opening 38 fluidly join at the inner area 15 of the cylinder 12.

The bottom wall 13*b* comprises an inlet inner surface 14*a* that defines and extends along the axial length of the fluid inlet 14 (extending between the outer surface of the bottom wall 13*b* and the inner area 15). The top wall 13*a* comprises an outlet inner surface 16*a* that defines and extends along the axial length of the fluid outlet 16 (extending between the outer surface of the top wall 13*a* and the inner area 15). The plunger housing side wall 13*c* comprises a plunger wall inner surface 18*a* that defines and extends along the axial length of the plunger bore 18 (extending between the outer surface of the plunger housing side wall 13*c* and the inner area 15). The access side wall 13*d* comprises an access wall inner surface 38*a* that defines and extends along the axial length of the access opening 38 (extending between the outer surface of the access side wall 13*d* and the inner area 15).

The fluid inlet 14 and the fluid outlet 16 are opposite each other along the height of the cylinder 12 (e.g., with the fluid inlet 14 along the bottom wall 13*b* and the fluid outlet 16 along the top wall 13*a*) such that the fluid inlet 14 and the fluid outlet 16 are coaxial, as depicted by axis 40 in FIG. 4. The fluid inlet 14 and the fluid outlet 16 provide fluid access into or out from the inner area 15 of the cylinder 12 (from the outside of the cylinder 12 (and outside the block 13)) through the bottom wall 13*b* and the top wall 13*a*, respectively. The block 13 may optionally include a common internal high-pressure discharge passage 16*b* (as shown in FIG. 4) that directly communicates with the fluid outlet 16 along the fluid outlet 16.

The plunger bore 18 and the access opening 38 are opposite each other along the width of the cylinder 12 (e.g., with the plunger bore 18 along the plunger housing side wall 13*c* and the access opening 38 along the access side wall 13*d*) such that the plunger bore 18 and the access opening 38 are coaxial, as depicted by axis 30 in FIG. 4. The plunger bore 18 and the access opening 38 provide access from the outer surface of the cylinder 12 (along the outer surface of the block 13) to the inner area 15 of the cylinder 12 through the plunger housing side wall 13*c* and the access side wall 13*d*, respectively. The respective (coaxial) axes of the plunger bore 18 and the access opening 38 are substantially perpendicular to the respective (coaxial) axes of the fluid inlet 14 and the fluid outlet 16 (i.e., axes 30 and 40 are substantially perpendicular to each other).

Figure 1:
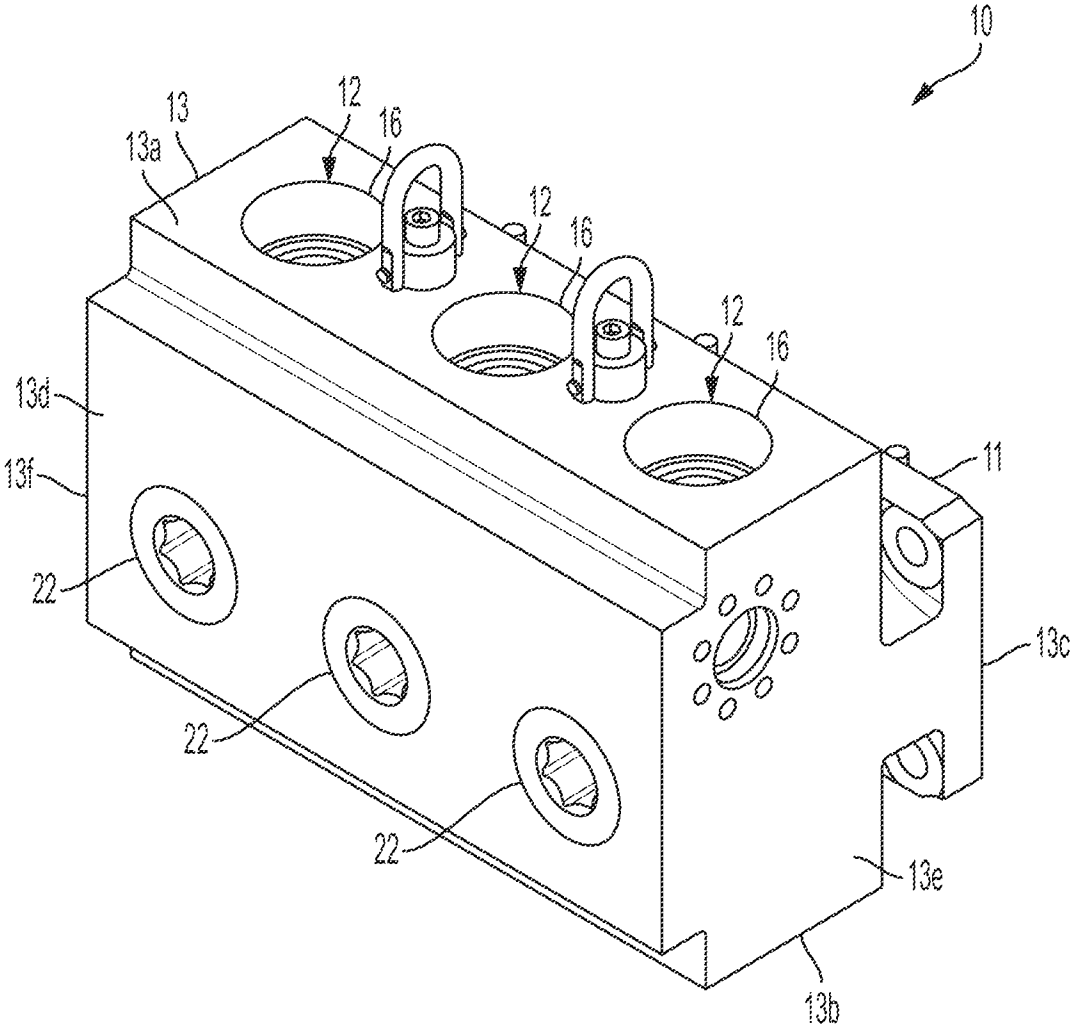
FIG. 1 shows a perspective view of a fluid end of a reciprocating pump assembly according to an exemplary embodiment.
Figure 3:
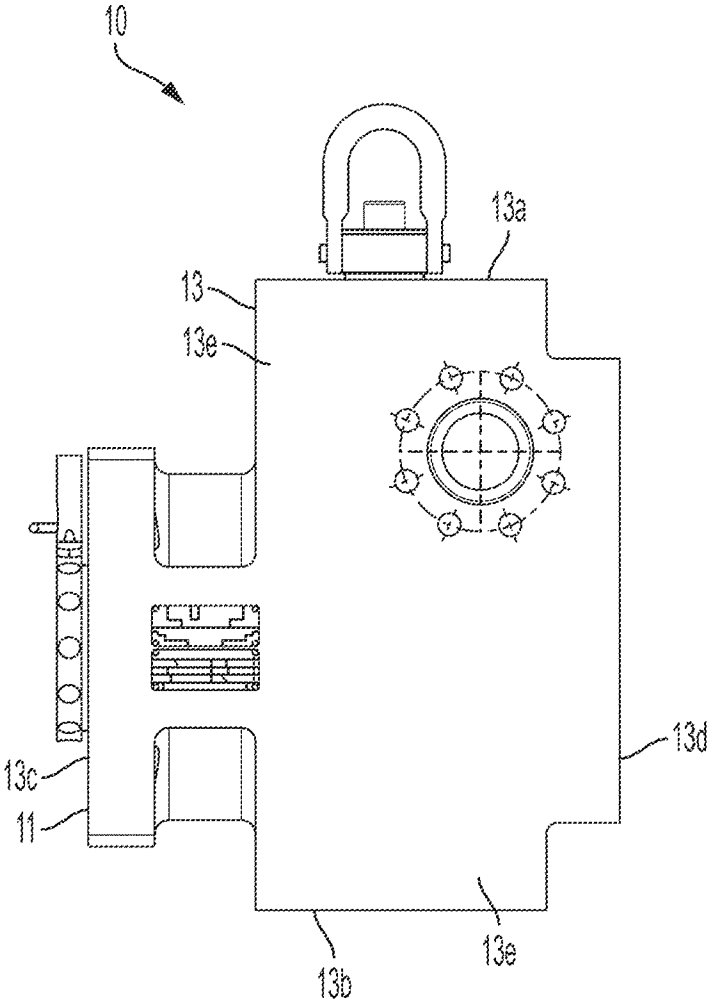
FIG. 3 shows a side view of the fluid end of the reciprocating pump assembly of FIG. 1.
Figure 2:
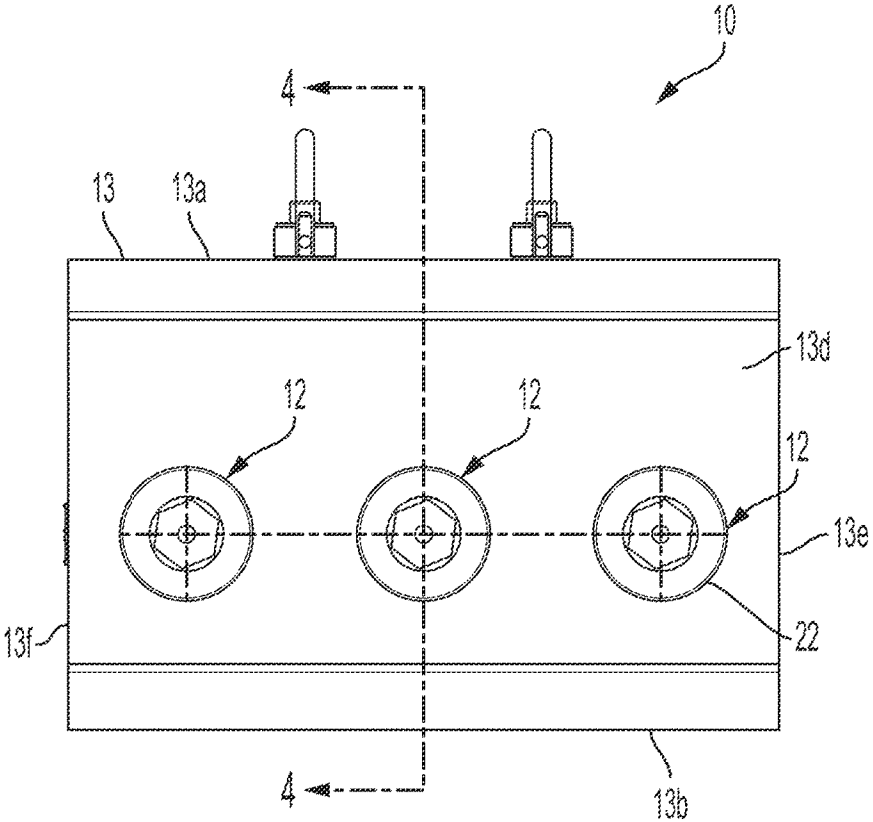
FIG. 2 shows a front view of the fluid end of the reciprocating pump assembly of FIG. 1.

The plunger housing side wall 13*c* is configured to couple with a plunger, piston, or plunger rod housing. In particular, the plunger housing side wall 13*c* is configured to receive the plunger, piston, or plunger rod housing. As shown in FIGS. 1 and 4, the block 13 further comprises a mounting portion 11 (with a mounting surface) that is positioned along the plunger housing side wall 13*c* and is configured to directly secure the fluid end 10 to the power end 120 of the pump assembly 100 through fasteners (e.g., bolts), as shown in FIG. 14.

The pumping cycle of the fluid end 10 is composed of two stages, a suction cycle and a discharge cycle. In the suction cycle, the plunger (which is at least partially within the plunger bore 18) translates outwardly along the plunger bore 18 and moves outwardly from within the cylinder 12 (away from the inner area 15), thereby lowering the fluid pressure in the inner area 15 of the cylinder 12, which draws fluid into the cylinder 12 through the fluid inlet 14. In the discharge cycle, the plunger translates inwardly along the plunger bore 18 in the opposite direction and moves forward and toward the inner area 15 of the cylinder 12, thereby progressively increasing the fluid pressure within the inner area 15 to a predetermined level for discharge through the fluid outlet 16 to a well site.

Referring to FIGS. 4 and 5, the fluid end 10 comprises a valve stop assembly 50 for each cylinder 12. The valve stop assembly 50 includes a cover 20, a cover plate 22, and optionally a valve stop 24. However, in situations where the cover 20 is used as a discharge cover, no valve stop is necessary.

The cover plate 22 and the cover 20 form a cover assembly and are structured to be mounted together and positioned in the access opening 38 of the cylinder 12 that provides access to the inner area 15 of the cylinder 12. As shown in FIGS. 4-5, the cover 20 is retained in the access opening 38 by the cover plate 22 (e.g., the cover 20 and the cover plate are coupled to each other). Accordingly, the access opening 38, the cover 20, and the cover plate 22 have an access opening axis, a cover axis, and a cover plate axis, respectively (each of which are depicted by axis 30) that are concentric and coaxial with each other. The axial direction of the access opening 38, the cover 20, and the cover plate 22 extends along axis 30. In various embodiments, the cover plate 22 and the cover 20 are two separate components that are attachable and directly couplable to each other. In various other embodiments, the cover 20 is integral with the cover plate 22 such that the cover 20 and cover plate 22 are formed as a single piece or single unitary component that cannot be separated without destruction.

The retainer nut or cover plate 22 couples with an end of the cylinder 12 opposite the plunger housing side wall 13*c*, in particular to the access side wall 13*d* and the access opening 38. The cover plate 22 is configured to retain the cover 20 within the access opening 38. The cover plate 22 is generally cylindrical in shape in order to fit and be positioned within the access opening 38.

Referring to FIGS. 7-10, the configuration of the cover 20 is shown. The cover 20 is configured to hold the valve stop 24 in place (by engaging with the flange 48 of the valve stop 24) within the cylinder 12 when fully installed. As described herein, the cover 20 can be a suction cover or a discharge cover, depending on the desired use. The cover 20 is generally cylindrical in shape and is platform along its axial length. The cover 20 comprises two end surfaces or sides (i.e., an exterior side 61 and an interior side 62) that are opposite each other in the axial direction. The cover 20 extends along its length between the exterior side 61 (that faces toward an outer surface of the access side wall 13*d* and away from the inner area 15, as shown in FIG. 4) and the interior side 62 (that faces toward the inner area 15 and away from the outer surface of the access side wall 13*d*, as shown in FIG. 4). The radial outer surface 25 refers to the radial outermost surface of the cover 20 that extends axially between the exterior side 61 and the interior side 62 and extends radially about the entire outside of the cover 20. The radial outer surface 25 is positioned radially outside of the radial outer surface of the protrusion 52.

The cover 20 comprises an end circumferential lip 21 that is positioned along the exterior side 61 of the cover 20 and extends around the entire outer perimeter of the cover 20. The end circumferential lip 21 of the cover 20 is the portion of the cover 20 with the largest outer diameter. As shown in FIG. 5, the end circumferential lip 21 is configured to abut against a portion (e.g., a ledge or step) of the access wall inner surface 38*a* to prevent the cover 20 from moving any further axially into the cylinder 12 (toward the inner area 15).

The cover 20 comprises a central circumferential lip 23 that is positioned axially between the exterior side 61 and the interior side 62 of the cover 20 (along the axial length of the cover 20) and extends around the entire outer perimeter of the cover 20. The outer diameter of the cover 20 along the central circumferential lip 23 (and the exterior side 61) is smaller than along the end circumferential lip 21 and larger than along the interior side 62. The outer diameter of the central circumferential lip 23 is approximately equal to the inner diameter of an interior portion of the access opening 38 such that the outer surface of the central circumferential lip 23 abuts against or contacts the access wall inner surface 38*a*.

The central circumferential lip 23 defines an inner portion 26 of the cover 20 that extends axially between an innermost side of the central circumferential lip 23 and the interior side 62 of the cover 20. The inner portion 26 is a part of the radial outer surface 25 of the cover 20. The outer diameter of the cover 20 along the inner portion 26 is smaller than the central circumferential lip 23 and smaller than the inner diameter of the interior portion of the access opening 38 and of the access wall inner surface 38*a*. Accordingly, when assembled, the inner portion 26 of the cover 20 is at least partially positioned within the access opening 38 and is radially spaced apart from the access wall inner surface 38*a* (about the entire inner portion 26) due to size differences, thereby allowing the cover 20 and the access wall inner surface 38*a* to form a radial groove or gap 51 between the radial outer surface 25 of the cover 20 (along the inner portion 26) and the access wall inner surface 38*a* (as shown in FIGS. 4-5). The radial gap 51 extends around the entire outer circumference of the cover 20.

Figure 9:
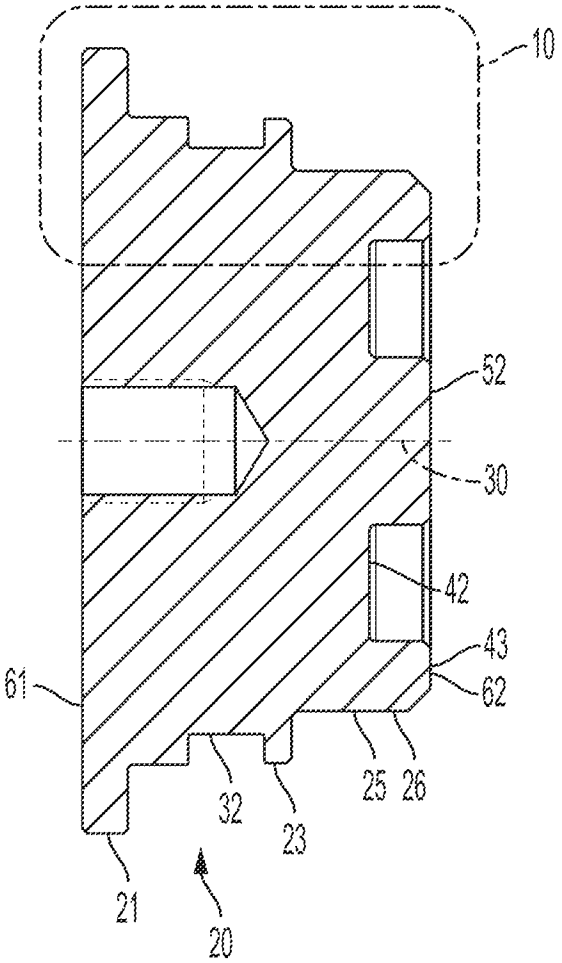
FIG. 9 shows a section view of the cover taken through section line 9-9 of FIG. 8.

As shown in FIGS. 5 and 9, the cover 20 defines a central recess 42 formed on the interior side 62 of the cover 20 such that the interior side 62 extends axially inwardly along the central recess 42. The central recess 42 is axially symmetric about axis 30. The cover 20 comprises an outer edge 43 along the interior side 62 that extends radially around and defines the radially outermost side of the central recess 42. The central recess 42 is completely radially surrounded by the outer edge 43.

As shown in FIGS. 5 and 9, the cover 20 further comprises a hub or protrusion 52 along the interior side 62 that defines the radially innermost side of the central recess 42 and protrudes from a central area of the central recess 42 toward the inner area 15 of the cylinder 12 (as shown in FIG. 4). The protrusion 52 is positioned within and completely radially surrounded by the central recess 42. The protrusion 52 is cylindrical, and the central axis of the central recess 42 and the protrusion 52 is coaxial with each other and with the axis 30 of the cover 20 and the access opening 38. The protrusion 52 and the outer edge 43 may optionally extend axially the same distance from the innermost surface of the central recess 42.

Figure 7:
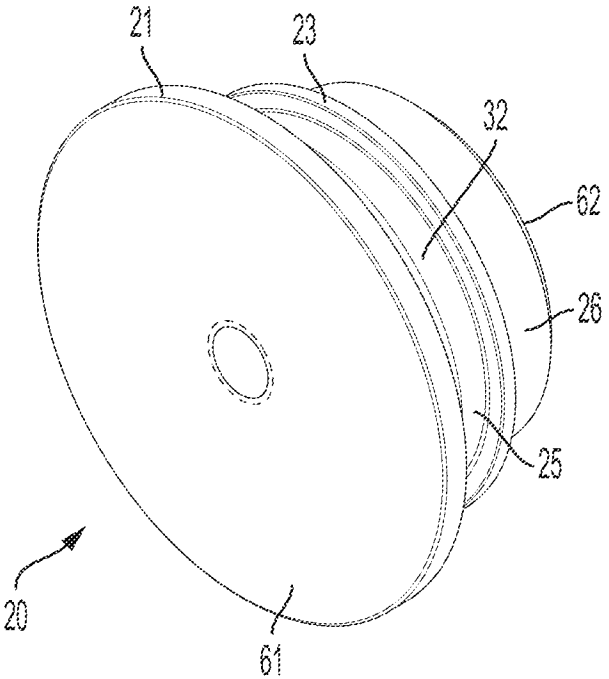
FIG. 7 shows a perspective view of a cover of the fluid end of FIG. 1.
Figure 10:
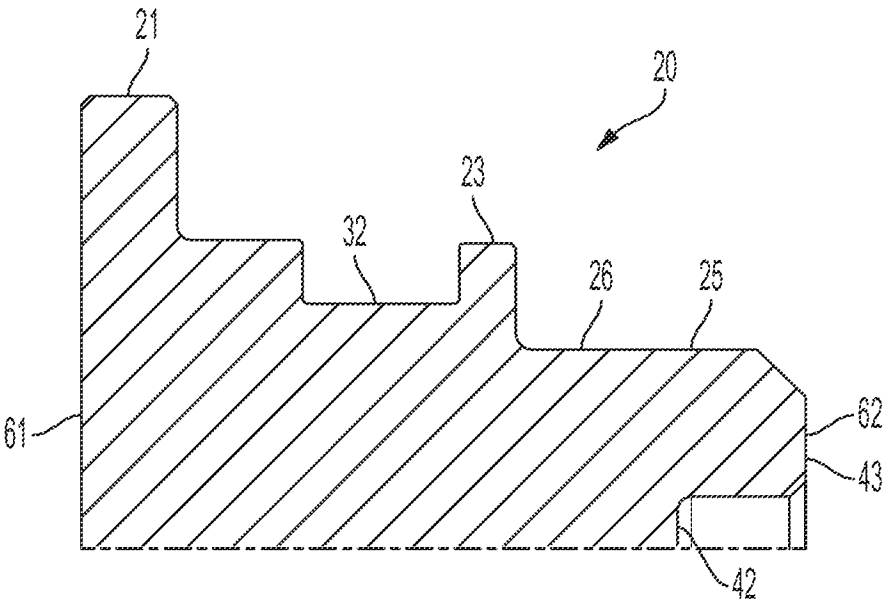
FIG. 10 shows a detailed section view of a portion of the cover of FIG. 9 taken at detailed portion 10.

As shown in FIGS. 7 and 9-10, the cover 20 defines a circumferential recess 32 that extends along the outer surface of the cover 20 (axially between the central circumferential lip 23 and an inner ledge axially between the central circumferential lip 23 and the end circumferential lip 21) and about the entire perimeter of the cover 20 such that the outer surface extends radially inwardly along the circumferential recess 32. The circumferential recess 32 is configured to secure at least one seal member along the length of the cover 20 such that the cover 20 forms a seal with the access wall inner surface 38*a* within the access opening 38.

Figure 6:
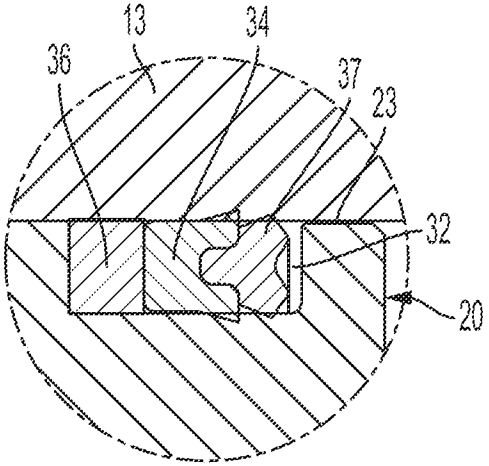
FIG. 6 shows a detailed section view of a portion of the fluid end of the reciprocating pump of FIG. 4 taken at detailed portion 6.
Figure 8:
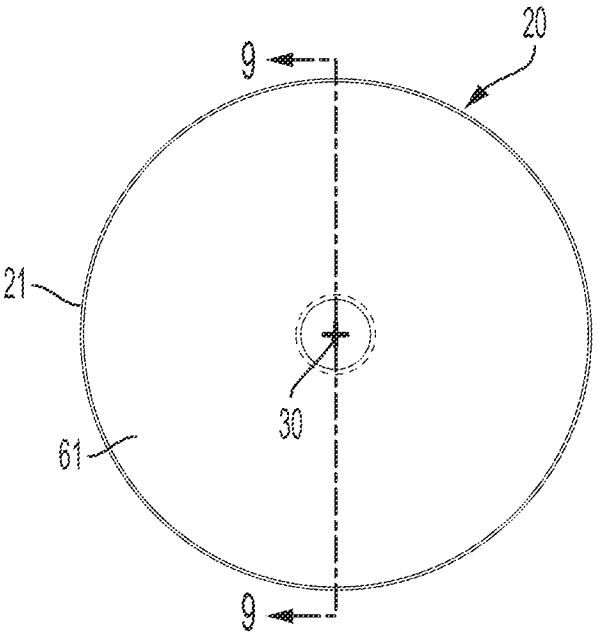
FIG. 8 shows a front view of the cover of FIG. 7.

The cover 20 is configured to form a seal with the access wall inner surface 38*a* along the access opening 38. Accordingly, the cylinder 12 of the fluid end 10 comprises at least one seal member (preferably a plurality of seal members) that is positioned within the circumferential recess 32 (between the radial outer surface 25 of the cover 20 along the circumferential recess 32 and the access wall inner surface 38*a*). The seal member is configured to form a seal between the cover 20 and the access wall inner surface 38*a* of the cylinder 12. For example, as shown in FIG. 6, the cover 20 comprises a primary seal member 34, a secondary seal member 36, and a tertiary seal member 37. The primary seal member 34, the secondary seal member 36 and the tertiary seal member 37 are mounted and positioned in the circumferential recess 32 formed on the outer surface of the cover 20. The order of the primary seal member 34, the secondary seal member 36, and the tertiary seal member 37 in the axial direction may be alternately arranged (e.g., switched or reordered) in another embodiment. In some embodiments, the primary seal member 34, the secondary seal member 36, and the tertiary seal member 37 may be formed as a single, integral seal member.

Referring back to FIGS. 4 and 5, the valve stop 24 is mounted adjacent to and positioned partially within one of the fluid ports (e.g., the fluid inlet 14 or the fluid outlet 16). The valve stop 24 is configured to prevent any fluid valves from moving (e.g., from moving from within the fluid inlet 14 into the inner area 15) and hold the fluid valve in place by providing a static area for the valves to move relative to and attach to. Although the fluid inlet 14 is referred to herein, the valve stop 24 may alternatively be positioned and used within the fluid outlet 16. The valve stop 24 is constructed as a single-piece. Accordingly, the valve stop 24 is a single, unitary, integral component that cannot be separated without destruction.

The valve stop 24 includes a valve stop main body, base, or spring retainer 54 for retaining the spring 28 relative to and within the fluid port (in particular the fluid inlet 14). The spring retainer 54 engages and presses against the upper or innermost end of the tapered portion of the fluid inlet 14 along the inlet inner surface 14*a* (such that the spring retainer 54 is positioned along the area connecting the fluid inlet 14 and the inner area 15). As shown in FIG. 5, the spring retainer 54 directly contacts and extends in a substantially straight line and radially between two opposite portions of the inlet inner surface 14*a* (and between two opposite sides of the fluid inlet 14.

The spring retainer 54 extends along only a portion of the cross-sectional area of the fluid inlet 14 such that fluid can flow past the spring retainer 54 and on both sides of the spring retainer 54. The spring retainer 54 comprises an inner surface 54*a* and an outer surface 54*b* that are opposite each other in the direction of fluid flow through the fluid inlet 14. The inner surface 54*a* faces toward and is closer to the inner area 15, and the outer surface 54*b* faces away from and is further from the inner area 15. The spring retainer 54 further comprises a first end 54*c* and a second end 54*d* that are opposite each other along the length of the spring retainer 54. As shown in FIG. 5, the first end 54 and the second end 54*d* are configured to directly contact the opposite sides of the inlet inner surface 14*a*.

Referring to FIGS. 5 and 11-13, the valve stop 24 includes an extension or column portion 45 extending axially from the inner surface 54*a* of the spring retainer 54 (relative to the axis 40 of the fluid inlet 14 and the fluid outlet 16). As shown in FIGS. 4-5, the column portion 45 extends at least partially into the inner area 15 of the cylinder 12. The column portion 45 may be positioned closer to and extend towards (and past) the first end 54*c* of the spring retainer 54. The column portion 45 includes a base 47, a flange 48 (or tongue), and a bushing 46.

Figure 13:
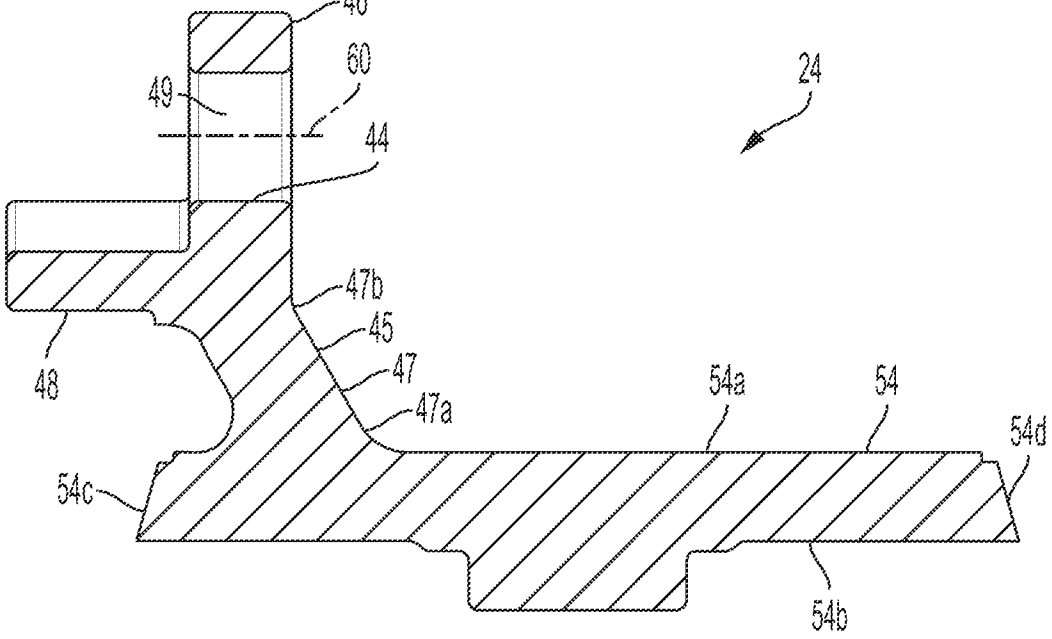
FIG. 13 shows a section view of the valve stop taken through section line 13-13 of FIG. 12.

The base 47 of the column portion 45 may extend in a substantially straight line and at an oblique angle relative to the inner surface 54*a* (in a direction towards the first end 54*c* of the spring retainer 54 and towards the inner area 15 and the access opening 38 when installed). As shown in FIG. 13, the base 47 includes a first end 47*a* and second end 47*b* that are opposite each other along the length of the base 47. The first end 47*a* of the base 47 is positioned along and extends directly from the inner surface 54*a* of the spring retainer 54. The second end 47*b* is positioned further from the inner surface 54*a* of the spring retainer 54 (relative to the first end 47*a*) and may optionally be positioned within the inner area 15 (as shown in FIG. 5).

The bushing 46 of the column portion 45 may be used for assembling the fluid end 10 and positioning the valve stop 24 within the cylinder 12. The bushing 46 is positioned along and extend from the second end 47*b* of the base 47 (in a direction away from the spring retainer 54). The bushing 46 may extend at an oblique angle relative to the base 47 and may be substantially perpendicular relative to the spring retainer 54 (in particular to the inner surface 54*a* of the spring retainer 54).

The bushing 46 includes a bushing inner surface 44 that defines a bushing opening or through-hole 49 (that extends completely through the bushing 46). The bushing 46 includes a bushing axis 60 of the bushing through-hole 49 (labelled in FIGS. 4 and 2-13) that extends axially along the center of the bushing through-hole 49 and is substantially parallel to, but is not coaxial with, the axis 30 of the cover 20 and the access opening 38 (i.e., the cover axis and the access axis, respectively). The bushing through-hole 49 may be an installation or packing nut bar hole that is configured to receive a portion of an installation tool (e.g., a packing nut bar) during installation of the valve stop 24 within the cylinder 12 (and to position the valve stop 24 correctly within the cylinder 12), where the installation tool may be extending through the access opening 38.

The flange 48 of the column portion 45 also is positioned along and extends from the second end 47*b* of the base 47. The flange 48 extends from the second end 47*b* in a direction substantially perpendicular to the bushing 46, substantially parallel to the spring retainer 54 (in particular to the inner surface 54*a* of the spring retainer 54), and in a direction towards the first end 54*c* (and away from the second end 54*d*). The flange 48 extends past the first end 54*c* (in the radial direction relative to the fluid inlet 14).

Figure 11:
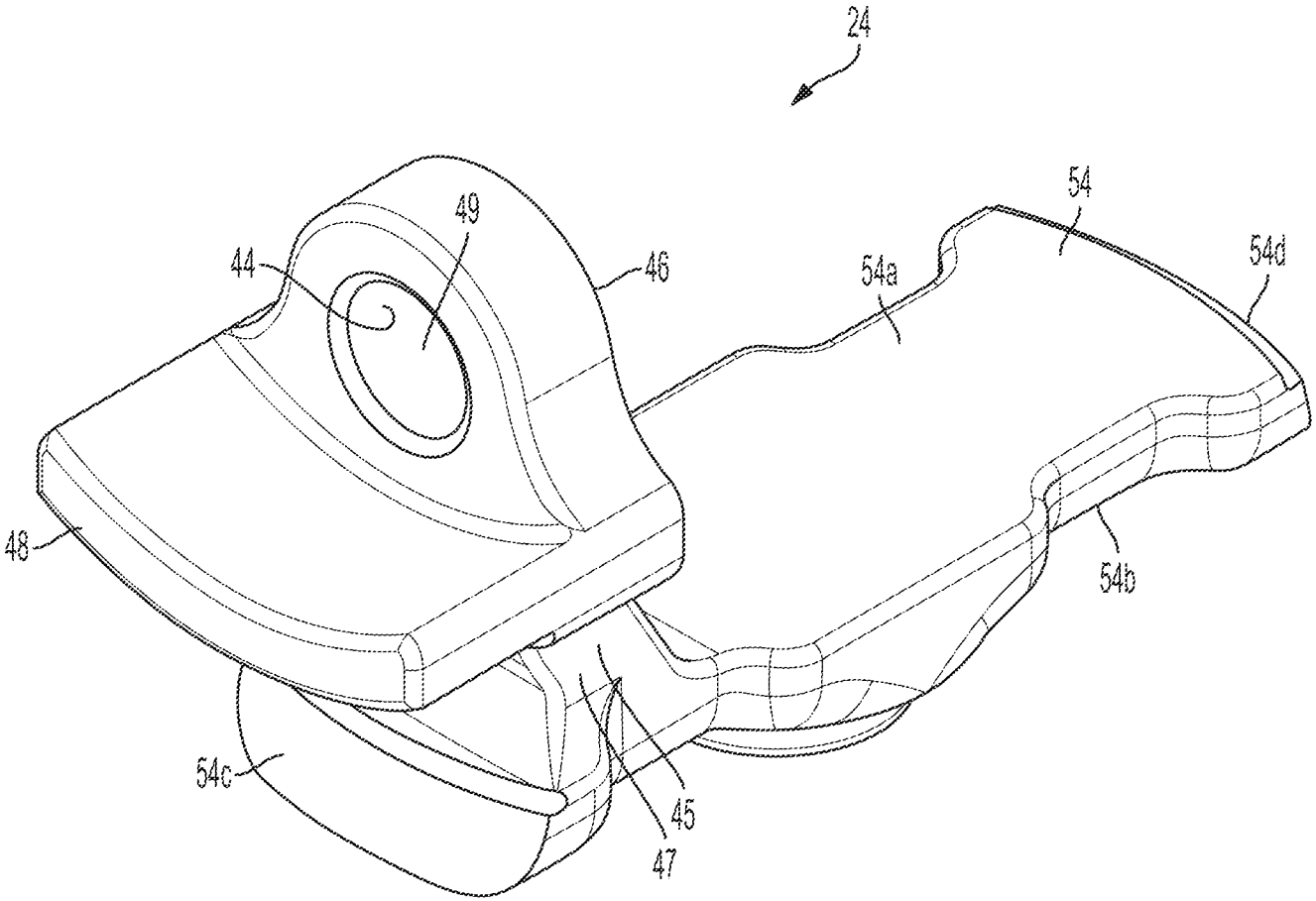
FIG. 11 shows a perspective view of a valve stop of the fluid end of FIG. 1.
Figure 12:
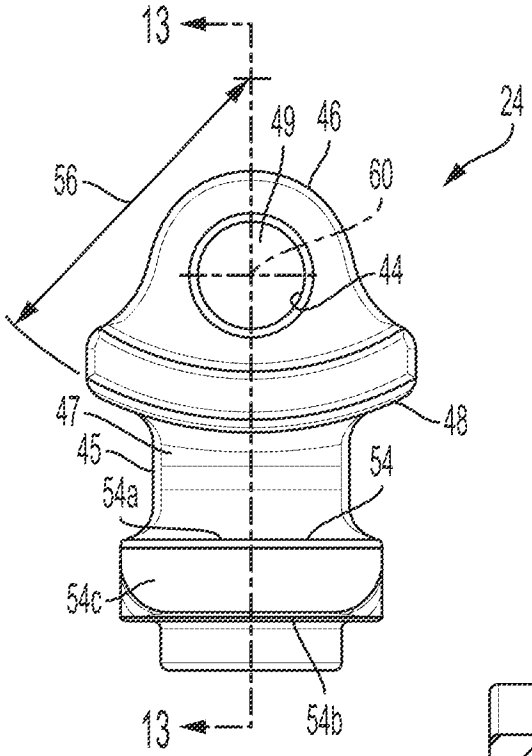
FIG. 12 shows a front view of the valve stop of FIG. 11.

As shown in FIGS. 11-12, the flange 48 has a curved arc shape. In particular, the flange 48 has an arc shape that forms only a portion of a circle and does not extend in a complete circle. The arc shape of the flange 48 is complementary to and fits around and within the radial outer surface 25 (or circumference) of the cover 20 and the access wall inner surface 38*a*, respectively. In particular, the radial inner surface of the flange 48 is sized and shaped to fit and extend along the radial outer surface 25 of the cover 20 (specifically along the inner portion 26 of the cover 20). The radial outer surface of the flange 48 is sized and shaped to fit and extend along the access wall inner surface 38*a*. Accordingly, the flange 48 is configured to fit and be positioned at least partially within the radial gap 51 formed radially between the radial outer surface 25 of the cover 20 and the access wall inner surface 38*a* (within the access opening 38), as shown in FIGS. 4-5.

By positioning the flange 48 within the radial gap 51, the valve stop 24 easily located to its position within the cylinder and is secured and held in place within the cylinder 12 after installation, thereby maintaining the correct alignment of the valve stop 24 relative to the cylinder 12. Furthermore, since the radial gap 51 extends around the entire outer circumference of the cover 20, the valve stop 24 (in particular the flange 48) can be positioned anywhere along the circumference of the cover 20, providing a circle of potential installation locations (and depending on the desired positioning and the configuration of the cylinder 12).

Since the flange 48 is in an arc shape (rather than a full circle), the flange 48 extends radially around only a portion of the radial outer surface 25 of the cover 20 (along the inner portion 26). Furthermore, the end of the flange 48 (opposite the end of the flange 48 extending directly from the base 47 of the column portion 45) may abut against an interior surface of the central circumferential lip 23. Accordingly, the flange 48 may extend axially along only a portion of the axial length of the cover 20.

To fit within the radial gap 51 and match the curvature of the radial outer surface 25 of the cover 20 along the inner portion 26 and the curvature of the interior portion of the access wall inner surface 38*a*, the arc of the flange 48 is formed as part of a circle with a radius 56, shown in FIG. 12. The radius 56 is defined as extending to the outer surface of the flange 48. In some embodiments, the radius 56 is approximately 2.6 inches. The radius 56 may be larger or smaller than 2.6 inches in other embodiments.

As shown in FIGS. 4 and 5, the flange 48 of the valve stop 24 is installed and positioned radially between the radial outer surface 25 of the cover 20 and the access wall inner surface 38*a* within the radial gap 51 formed therebetween. The radius 56 of the flange 48 is designed such that the flange 48 fits within the radial gap 51 (e.g., the radius 56 is smaller than the radius of the access wall inner surface 38*a* and larger than the radius of the cover 20 along the inner portion 26).

Accordingly, as shown in FIGS. 4-5, when assembled (and while the spring retainer 54 is positioned within the fluid inlet 14), the flange 48 of the valve stop 24 extends axially along a portion of the axial length of the cover 20 and radially around only a portion of the radial outer surface 25 of the cover 20 (along the inner portion 26). Additionally, at the same time, the bushing 46 extends radially along the interior side 62 of the cover 20. By positioning the flange 48 and the bushing 46 in such a manner relative to the cover 20, the valve stop 24 is accurately aligned with the cover 20 and the cylinder 12.

The specific design of the valve stop 24 allows the cover 20 to be used interchangeably as either a suction cover or a discharge cover, according to the desired use. The same design of the cover 20 can be used for both the cover 20 as a suction cover or the cover 20 as a discharge cover because the bushing 46 of the valve stop 24 does not need to be (and is not) aligned with and fitted over a hub or post (such as the protrusion 52) on the cover 20 for alignment and assembly. Instead, the flange 48 of the valve stop 24 fits radially between the outer diameter of the cover 20 (along the inner portion 26) and the access wall inner surface 38*a* of the cylinder 12.

In addition, the design of the valve stop 24 as described herein allows for an easier installation as compared with prior valve stop assemblies. For example, instead of assembling a valve stop into the cylinder by aligning the valve stop with an arbitrary point in space with no reference available to center the valve stop, in this design, the flange 48 of the valve stop 24 can simply be installed radially in between the cover 20 and the access wall inner surface 38*a* formed within the cylinder 12. In assembling the valve stop 24 described herein into the cylinder 12, an existing tool (e.g., a packing nut bar) that is already used with a packing nut of the pump can be used. Accordingly, no custom or specifically designed tool is needed to install and remove the valve stop 24, thereby improving manufacturing and assembly.

It should be noted that any use of the term "example" herein to describe various embodiments is intended to indicate that such embodiments are possible examples, representations, and/or illustrations of possible embodiments (and such term is not intended to connote that such embodiments are necessarily extraordinary or superlative examples).

As utilized herein, the term "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed (e.g., within plus or minus five percent of a given angle or other value) are considered to be within the scope of the invention as recited in the appended claims. The term "approximately" when used with respect to values means plus or minus five percent of the associated value.

The terms "coupled" and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the figures. It should be noted that the orientation of various elements may differ according to other example embodiments, and that such variations are intended to be encompassed by the present disclosure.

It is important to note that the construction and arrangement of the various example embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Additionally, features from particular embodiments may be combined with features from other embodiments as would be understood by one of ordinary skill in the art. Other substitutions, modifications, changes and omissions may also be made in the design, operating conditions and arrangement of the various example embodiments without departing from the scope of the present invention.

What is claimed is:

1. A fluid end of a reciprocating pump assembly comprising:

a cylinder having a fluid inlet, a fluid outlet, and an access side wall comprising an access wall inner surface that defines an access opening, the access opening providing access to an inner area of the cylinder and having an access opening axis;

a cover positioned in the access opening and forming a seal with the access wall inner surface along the access opening, the cover comprising a cover axis coaxial with the access opening axis; and a valve stop positioned partially in the fluid inlet, the valve stop comprising a spring retainer and a column portion, the column portion comprising a base, a flange, and a bushing, wherein the bushing comprises a bushing inner surface that defines a bushing through-hole such that when the valve stop is positioned partially in the fluid inlet, the through hole is not aligned with and fitted over a hub or post, and wherein the flange is positioned between the cover and the access wall inner surface, the flange comprising an arc shape.

2. The fluid end of claim 1, wherein the flange is positioned in a radial gap formed between a radial outer surface of the cover and the access wall inner surface.

3. The fluid end of claim 1, further comprising one or more seal members positioned between and forming a seal between the cover and the access wall inner surface.

4. The fluid end of claim 3, wherein the cover defines a circumferential recess, the one or more seal members are mounted in the circumferential recess and positioned between a radial outer surface of the cover along the circumferential recess and the access wall inner surface.

5. The fluid end of claim 1, wherein the cover comprises a suction cover.

6. The fluid end of claim 1, wherein the further comprising a second cover identical to the cover, the second cover positioned as comprises a discharge cover to cover a high pressure discharge fluid outlet of the fluid end.

7. The fluid end of claim 1, further comprising a cover plate coupled to and retaining the cover within the access opening.

8. The fluid end of claim 1, wherein a bushing axis of the bushing through-hole is not coaxial with the cover axis.

9. The fluid end of claim 1, wherein the flange extends in a substantially perpendicular direction from the bushing.

10. The fluid end of claim 1, wherein the cover defines a central recess and comprises a protrusion positioned within the central recess and protruding from the central recess toward the inner area of the cylinder, wherein the central recess and the protrusion are coaxial with the access opening axis.

11. A valve stop assembly comprising:

a cover comprising a cover axis;

a valve stop comprising a spring retainer and a column portion extending from the spring retainer, the column portion comprising a flange and a bushing extending from the column portion, wherein the bushing comprises a bushing inner surface that defines a bushing through-hole such that when the valve stop is positioned in a fluid inlet of a fluid end of a reciprocating pump assembly, the through hole is not fitted over a hub or post; and wherein the flange comprises an arc shape.

12. The valve stop assembly of claim 11, wherein the cover comprises a suction cover.

13. The valve stop assembly of claim 11, further comprising a second cover identical to the cover and positionable as a discharge cover to cover a high pressure discharge fluid outlet of the fluid end.

14. The valve stop assembly of claim 11, wherein the arc shape of the flange is complementary to and fits around a radial outer surface of the cover.

15. The valve stop assembly of claim 11, wherein a bushing axis of the bushing through-hole is configured so as not to be coaxial with the cover axis when the valve stop is positioned in a fluid inlet of a fluid end of a reciprocating pump assembly.

16. The valve stop assembly of claim 11, wherein the flange extends in substantially perpendicular direction from the bushing.

17. The valve stop assembly of claim 11, wherein the cover defines a central recess and comprises a protrusion positioned within the central recess and protruding from the central recess, wherein the central recess and the protrusion are coaxial with each other.

* * * * *